United States Patent [19]

Bannert et al.

[11] 4,274,701

[45] Jun. 23, 1981

[54] LOCKABLE CONTACT SOCKET FOR INSERTION INTO A PLUG CONNECTOR

[75] Inventors: Johann Bannert, Traubing; Guenter Nagel, Munich, both of Fed. Rep. of Germany

[73] Assignee: Siemens Aktiengesellschaft, Berlin & Munich, Fed. Rep. of Germany

[21] Appl. No.: 881,013

[22] Filed: Feb. 24, 1978

[30] Foreign Application Priority Data

Mar. 29, 1977 [DE] Fed. Rep. of Germany ..... 2713894

[51] Int. Cl.[3] ..... H01R 13/428

[52] U.S. Cl. ..... 339/217 S; 339/64 R

[58] Field of Search ..... 339/217 S, 64 R, 64 M

[56] References Cited

U.S. PATENT DOCUMENTS

| | | | |
|---|---|---|---|
| 3,233,208 | 2/1966 | Ruehlemann et al. | 339/217 S |
| 3,601,775 | 8/1971 | Longenecker et al. | 339/217 S |
| 3,685,001 | 8/1972 | Krafthefer | 339/217 S |
| 4,101,192 | 7/1978 | Bauerle et al. | 339/217 S |

FOREIGN PATENT DOCUMENTS

| | | | |
|---|---|---|---|
| 1515580 | 7/1969 | Fed. Rep. of Germany | 339/217 S |
| 2454317 | 5/1976 | Fed. Rep. of Germany | 339/217 S |
| 1384648 | 2/1975 | United Kingdom | 339/217 S |

*Primary Examiner*—Neil Abrams

*Attorney, Agent, or Firm*—Hill, Van Santen, Steadman, Chiara & Simpson

[57] ABSTRACT

In the illustrated embodiment, the spring arms have an integral connecting web rearwardly from the pin contact region so as to form a U-shaped locking spring with rearwardly directed locking edges. As the spring system is assembled into a spring chamber, a tapering face progressively bends the legs of the locking spring inwardly, a locking edge springing outwardly to engage in front of a ledge as the system reaches the operating position, and the forward edge of the web restraining further forward movement. Each spring system is thus locked in operating position while being individually removable by means of a blade inserted from the forward side of a connector assembly having multiple rows of spring chambers.

1 Claim, 1 Drawing Figure

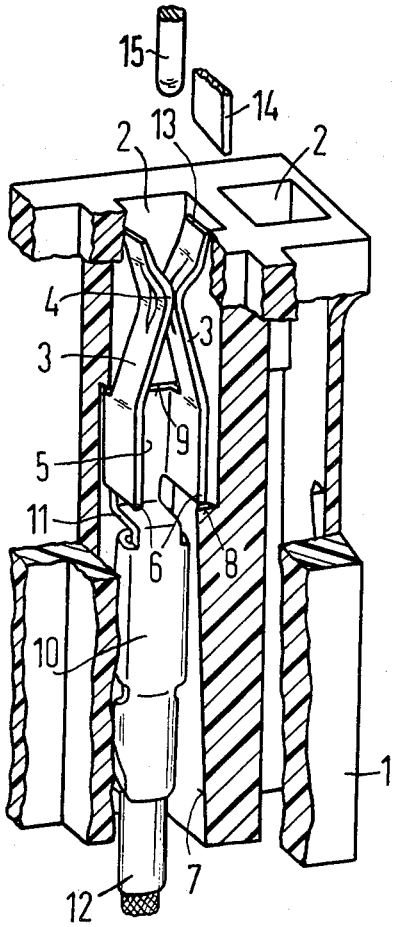
15
14
2
13
2
4
3
3
9
5
11
6
8
10
1
7
12

LOCKABLE CONTACT SOCKET FOR INSERTION INTO A PLUG CONNECTOR

BACKGROUND OF THE INVENTION

The invention relates to an electrical contact device having contact arms and locking elements for locking a contact socket behind locking edges in spring chambers of multipolar plug connectors, or the like.

With data processing machines, the structural elements are combined to assemblies which can individually be plugged in to facilitate production and maintenance. For this purpose, mainly circuit boards made of moulded laminated plastic and having etched or printed conductor paths are suitable. These conductor paths are connected among one another either directly via so-called plug connecting elements or, when a higher transmission quality is required, via plug connectors which are arranged on the circuit boards.

Owing to the packing density and the dense concentration of the structural elements resulting therefrom, the contact clearances of the contact sockets or bushes in the plug connectors are also very narrow, and the contact bushes themselves are very small.

Contact sockets of the kind referred to are, in general, produced by virtue of the fact that contact sockets are locked in a casing which is produced by a die-casting process. These contact sockets vary with regard to their design, depending on the use of the finished plug connector.

Moreover, the contact sockets have to be manufactured in such a way that they can easily be removed, in order to replace the contact sockets when a conductor connection is faulty, or also, to allow for different contacting when new connections are to be set up.

Despite the small size of the individual contact sockets, they have to be manufactured in such a way that they can be contacted by the crimp technique. When employing this crimp technique, the contact sockets are mechanically contacted by means of pressing together the connecting part of the contact sockets with the line to be connected. But in order to enable conventional soldering at the same time, it is necessary to design the entire connecting socket and especially its connecting part in such a way that both contacting methods can be employed without experiencing any change in respect of the mechanical and electrical properties of the spring region of the contact bushes.

In order to fulfill these requirements, it is well-known to provide contact sockets where in the region of the contact part of the contact bush a cushioned lug is provided which is bent out and locks behind a locking edge on insertion of the contact socket into the plug connector casing.

In order to replace such a contact socket inside the plug connector casing, said bent out lug is lifted back across the locking edge via a pointed replacement tool, and the contact socket is removed from the casing.

In the case of a further known plug connector, integrated locking spings are arranged in the individual casing sections in the plug connector casing itself, and on insertion of the contact socket into the spring chambers, said locking springs lock this contact socket via notchings in the casing.

By means of locking springs integrated in this manner, it is, indeed, possible to set up plug connectors having up to two casing sections, but with multiple-row plug connectors, where the individual casing sections are to be agglutinated, it is no longer possible to set up locking elements integrated in this manner. Locking elements situated in the central position can no longer be deflected and, therefore, replacement of the contact sockets is no longer possible.

SUMMARY OF THE INVENTION

It is the aim of the invention to produce an electrical contact device having a contact socket which in a simple manner can be locked in the spring chambers of a plug connector, or the like, and can still be replaced easily. The contact socket should be designed in such a way that with it various contacting methods can be carried out without experiencing notable changes in respect of its electrical and mechanical properties.

This aim is realized in accordance with the invention by virtue of the fact that at least one of the spring arms, which are connected via a resilient transverse element and thus clamped at one end, is in the form of a locking element.

In the case of a special embodiment of the invention, a face ending in a locking chamber is provided in the spring chamber, and on insertion of the contact socket into the spring chamber, first of all, the face compresses the latter in the clamping region of the spring arms.

By virtue of the fact that in the case of the invention the spring arms themselves are employed to lock the entire contact socket in place, the contact socket itself can be produced in a simple manner. Moreover, it is particularly easy to lock and replace the contact socket.

Concerning a particularly advantageous embodiment of the invention, the transverse element and the actual connecting region of the contact socket are connected via an elastic element.

Such a mechanical decoupling of the actual contact bush from its connecting region makes the electrical and especially the mechanical properties of the contact socket independent of the initial contacting methods which may be used. If, for example, a connecting wire is soldered into the connecting region of the contact socket, the connecting region is, indeed, strengthened. But this mechanical modification does not affect the contact region of the contact socket itself.

An embodiment of the invention is shown in the drawing and explained in detail in the following by way of example; other objects, features and advantages will be apparent from this detailed disclosure and from the appended claims.

BRIEF DESCRIPTION OF THE DRAWING

The single FIGURE shows a schematic representation of the electrical contact device in a plug connector.

DETAILED DESCRIPTION

Spring chambers 2 for receiving contact sockets are arranged in the casing 1 of a plug connector for flat assemblies. These contact sockets or bushes have been prepared from a piece of metal by the stamping method. Two spring leaves 3 receiving a contact pin 15 are provided with arched formations 4 in the vicinity of their contact area. These arched formations 4 serve to open the prestressed springs 3 according to the width of the applied contact pin 15, in order to attain thereby the smallest possible plug-in force of the connecting pin. The arched formations 4 are arranged at the edge of the contact areas and, at the same time, serve as guidance for the contact pin 15 to be inserted.

The spring leaves 3 are connected at one end via a resilient transverse element 5. This resilient transverse element 5 together with the rear part of the spring leaves 3 forms a U-shaped spring, the arms 6 of which can spring together. Due to this springing together of the arms 6, it is possible to lock the contact socket in the plug connector or in its spring chambers 2 in a simple manner, namely in that on insertion of the contact socket into a spring chamber 2, the contact arms 3, 6, i.e. the spring leaves 3 together with their arms 6, spring together by virtue of a face 7 situated in the spring chamber 2. When the contact socket is in the working position, the arms 6 of the spring leaves open again and lock behind a locking edge 8.

The plug-in region of the contact socket in the spring chamber is limited by a further locking edge 9 receiving the forward edge of the transverse element 5.

The contact socket is replaced by inserting a knife-shaped tool 14 into the spring chamber 2.

An elastic or resilient element 11 is arranged between the actual connecting region 10 of the contact spring and the spring region. This elastic element 11 consists of an S-shaped, bent connecting piece between the transverse element 5 and the connecting region 10 and has the task to decouple mechanically the actual connecting region from the contact region. Due to this decoupling, the spring system can conform to the respective pin position of the connecting pin 15 within the scope of the tolerances in the spring casing 1. Moreover, by means of such a decoupling it is possible to dimension the spring system as well as the connecting zone 10 independently of one another. This is important when as shown here, by using the so-called crimp technique, contacting takes place by pressing the line 12 into the connecting piece 10, but on the other hand, when it is also intended to solder the line 12 into the connecting piece 10 or to form the connecting piece in such a way that a connection, which is arranged at the rear end of the connecting piece 10 and appropriately shaped is soldered into the circuit board.

It will be apparent that many modifications and variations may be effected without departing from the scope of the novel concepts and teachings of the present invention.

We claim:

1. An electrical assembly comprisinng a plug connector casing having a spring chamber with one end being arranged to receive a connecting pin, a contact socket in said spring chamber and having contact arms extending toward said one end of the spring chamber and having first ends providing respective contact portions for engaging a connecting pin inserted into said spring chamber through said one end thereof, said contact arms having second ends (6) with a resilient transverse element (5) extending therebetween at one side of the spring chamber to form a U-shaped spring configuration, the forward edge of the transverse element (5) providing a stop for determining the insertion depth of the contact socket into the spring chamber, and the second end of one of the contact arms providing a rearwardly directed locking edge for releasably retaining the contact socket against removal from the spring chamber, the plug connector casing including a locking means (8) lying behind said locking edge of the second end of the one of said contact arms, and a further locking means (9) lying in front of said forward edge of said transverse element (5), and means providing clearance along the side of the spring chamber confronting said one of said contact arms for accommodating insertion of a blade through the one end of the spring chamber for the purpose of deflecting said locking edge of said one contact arm out of engagement with said locking means (8) to enable removal of the contact socket from the spring chamber, the contact socket having an elastic element (11) and an actual connecting region (10), the spring arms and the transverse element (5) being connected with the region (10) via said elastic element (11), said resilient transverse element of said U-shaped spring configuration consisting essentially of a rectilinear generally planar strip (5) of metal having a rear margin parallel to said forward edge, and having lateral margins defining a longitudinal dimension of said strip (5), said rear margin of said strip (5) lying generally in a common plane with said locking edge which common plane is perpendicular to said strip (5), said second ends (6) being integral with and contiguous to the respective lateral margins of said rectilinear strip (5) over the entire extent of said second ends (6) such that the locking edge is contiguous to and directly merges with said rear margin of said strip without any gap therebetween, said elastic element (11) being of S configuration and comprising a first rectilinear strip portion integral with the rear margin of said strip (5) and generally coplanar therewith, said first strip portion extending rearwardly from the generally common plane of said locking edge and said rear margin, said elastic element (11) further comprising a second rectilinear strip portion joining integrally with said first strip portion and forming a first bend therewith which first bend is parallel with said rear margin of said strip (5), said second strip portion having a longitudinal extent such that the second strip portion overlies a major proportion of a height dimension to which the locking edge extends from said strip (5) which height dimension is perpendicular to said strip (5), said elastic element (11) further comprising a third strip portion joining with the second strip portion and forming a second bend therewith which second bend is substantially parallel to said first bend and is of a configuration such that the third strip portion extends rearwardly and is offset from the first strip portion in the direction perpendicular to said strip (5) by approximately the height dimension to which said locking edge extends from said strip (5), said connecting region (10) being connected with said third strip portion, said connecting region (10) being connected with said second strip portion only via said second bend, and being connected with said first strip portion only via said second bend, said second strip portion, and said first bend.

* * * * *